United States Patent [19]

Lee

[11] Patent Number: 4,752,255

[45] Date of Patent: Jun. 21, 1988

[54] SPADE LUG

[76] Inventor: Noel Lee, 47 West Park Dr., Daly City, Calif. 94015

[21] Appl. No.: 934,178

[22] Filed: Nov. 24, 1986

[51] Int. Cl.[4] ..... H01R 4/18

[52] U.S. Cl. ..... 439/881; 439/877

[58] Field of Search ..... 339/276 F, 277 R, 276 R, 339/256 SP, 257, 258 S; 439/877, 881

[56] References Cited

U.S. PATENT DOCUMENTS

| | | | |
|---|---|---|---|
| 422,058 | 2/1890 | McIntyre | 339/276 F X |
| 582,462 | 5/1897 | Dickerson | 339/277 R |
| 783,061 | 2/1905 | Mills | 339/257 |
| 2,264,040 | 11/1941 | Johnson et al. | 339/277 R |
| 3,728,669 | 4/1973 | Churla | 339/277 R X |

*Primary Examiner*—Eugene F. Desmond

*Attorney, Agent, or Firm*—Warren B. Kice

[57] ABSTRACT

A spade lug for connecting an electrical conductor to an electrical terminal in which two legs extend from a base member in a spaced parallel relation. An extension is formed on one of the legs and extends at an angle thereto. In this manner, the legs can extend around a threaded binding post and can be secured thereto by a nut or, alternatively, the extension can be inserted into a terminal having an opening for receiving a conductor or a pin type connector.

3 Claims, 1 Drawing Sheet

SPADE LUG

BACKGROUND OF THE INVENTION

This invention relates to a spade lug, and more particularly to a spade lug for making an electrical connection between a conductor attached to the spade lug and one of several different electrical terminals.

Spade lugs are often connected to an electrical conductor in order to facilitate a connection between the conductor and a terminal such as that found on an audio amplifier, loudspeaker, or the like. Although the terminals on most electrical components use a threaded binding post, for which a spade lug is ideally suited, other types of terminals, such as those having an opening for receiving the conductor or a pin-type connector which is connected to the conductor, are becoming more popular. Thus when an electrical component having a threaded binding post is replaced by a component having a different terminal, all spade lugs utilized to connect conductors to the old component have to be removed or replaced, which is expensive and time consuming.

SUMMARY OF THE INVENTION

It is therefore an object of the present invention to provide a spade lug which can be utilized in connection with a terminal having threaded binding post and having an opening for receiving a conductor or a pin type connector.

It is a further object of the present invention to provide a spade lug of the above type which is formed by two parallel leg portions adapted to extend around a binding post with one of the leg portions having an extension for extending in an opening defined by a terminal.

Toward the fulfillment of these and other objects, the spade lug of the present invention comprises a pair of spaced parallel legs extending from a base member which is preferably in the form of a sleeve. The legs extend at an angle to the axis of the sleeve and an extension is formed on one of the legs and extends at an angle thereto.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
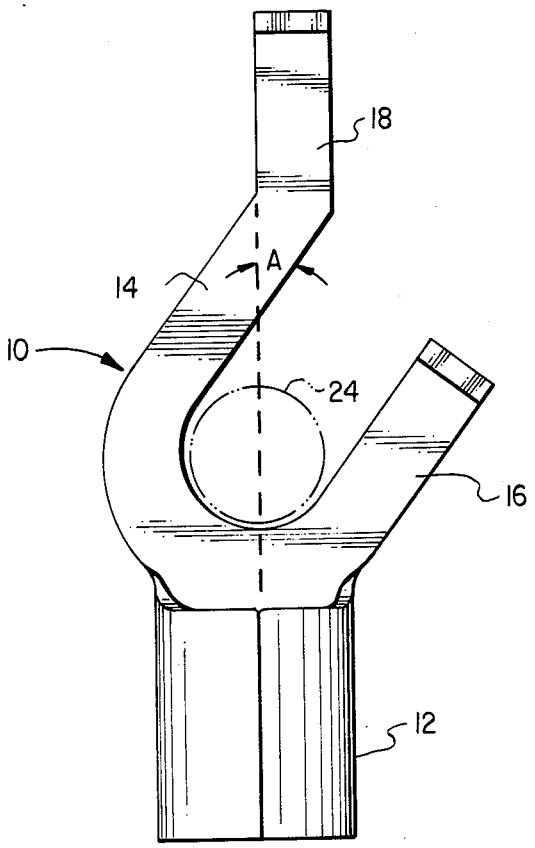
FIG. 1 is a front elevational view of the spade lug of the present invention.

Referring to the drawings, the reference numeral 10 refers, in general, to the improved spade lug according to the present invention. The spade lug 10 is found by a strip, or plate, of electrical current conducting material, such as copper, brass, or copper or brass-plated metal, and is stamped or otherwise cut into the configuration shown.

The lower portion of the spade lug 10 includes a base portion which is formed into a crimping barrel, or sleeve, 12 by bending the lower opposite edge portions of the strip inwardly until they abut. The upper portion of the strip is cut into a generally U-shaped pattern with the legs 14 and 16 of the U extending at an angle A to the longitudinal axis of the sleeve 12, which axis is shown by the dashed line in FIG. 1. The upper end portion of the leg 14 has an extension 18 which is disposed at an angle to the leg 14 which angle corresponds to the angle A so that the longitudinal axis of the extension 18 extends parallel with the longitudinal axis of the sleeve 12.

Figure 2:
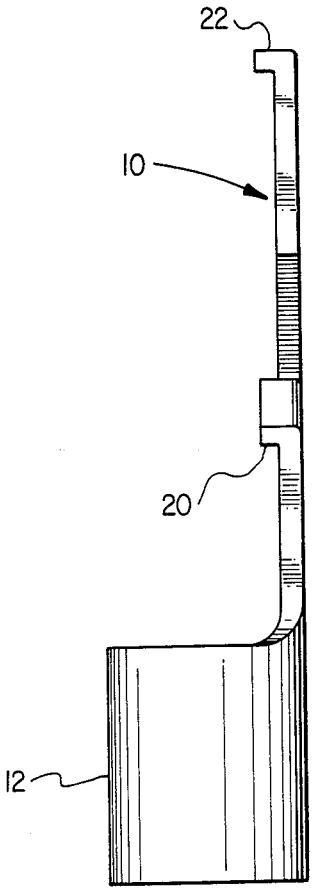
FIG. 2 is a side elevational view of the spade lug of FIG. 1.

The ends of the leg 16 and the extension 18 are bent forward, or towards the sleeve 12, as shown in FIG. 2 by the reference numerals 20 and 22, respectively, for reasons that will be explained.

Prior to use, a conductor (not shown) is stripped of insulation at its end portion and the latter placed in the sleeve 12. The latter is then crimped over the stripped conductor portion by a pair of pliers, or the like, to secure the conductor in the sleeve 12, it being understood that a solder connection can be made in place of, or in addition to, the crimped connection.

The spade lug 10 can be used in a conventional manner by placing it over a threaded binding post which is shown by the phantom lines 24 in FIG. 1, with the legs 14 and 16 flanking the post. Thus a binding nut (not shown) associated with the post can be tightened over the spade lug to secure it around the post 24 and thus complete the electrical connection between the conductor in the sleeve 12 and a similar conductor (not shown) connected to the binding post. The bent portions 20 and 22 are provided for aiding in securing or stabilizing the connection and can engage raised portions, or the like, of the terminal to prevent rotation or angular movement of the spade lug 10 relative to the terminal.

The spade lug 10 of the present invention also can be used with a terminal (not shown) of the type having a through opening, or bore, for receiving a conductor or a pin type connector which is connected to the conductor. These types of terminals include a spring-loaded button which is pushed to expose the opening, or bore, or a threaded nut which extends over a shaft, or post, having the opening formed therethrough. In any case, an electrical circuit between the conductor connected to the spade lug 10 and a conductor electrically connected to the terminal is completed. The spade lug 10 of the present invention can be used with this type of terminal by simply inserting the extension 18 into the above-mentioned opening and either releasing the spring-loaded push button or advancing the nut over the post to secure the connection. The leg 16 does not interfere with the connection (as would be the case with a conventional spade lug) since it extends at an angle to the extension 18 and is shorter in length than the extension.

It is thus seen that several advantages result from the foregoing. For example, the spade lug 10 of the present invention can easily be utilized in connection with a conventional threaded binding post by simply placing the two legs 14 and 16 around the binding post 24 as described above before the nut in threaded engagement with the binding post is advanced over the spade lug to complete the connection. Alternatively, the spade lug of the present invention can be used in connection with a terminal having an opening for receiving the conductor, or a pin type connector by inserting the extension 18 in the opening provided in the latter terminal before securing the connection in the manner described above.

Thus the spade lug 10 of the present invention provides an electrical connection between a conductor and one of several different types of terminals in a simple, quick and efficient manner.

Also, the spade lug of the present invention can be utilized with the most popular type of terminal connections without the necessity of replacing the spade lug with another type connector.

It is understood that variations may be made in the foregoing without departing from the scope of the invention. For example, the base portion of the spade lug 10 of the present invention is not limited to a sleeve as shown, but can be in the form of any other type of base portion suitable for electrical connection to a conductor.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the spirit and scope of the invention therein.

What is claimed is:

1. A spade lug comprising a sleeve for receiving an electrical conductor, two parallel legs formed integral with, and extending from, said sleeve and spaced apart a distance sufficient to accommodate a binding post of an electrical terminal, each of said parallel legs extending at an angle to the axis of said sleeve and an extension formed on one of said legs for extending within an opening in another electrical terminal, said extension extending at an angle to said one leg and parallel with the axis of said sleeve.

2. The spade lug of claim 1 wherein said extension and the other leg each include a straight portion extending from said sleeve and a free end portion bent so as to extend substantially perpendicularly to said straight portion to facilitate connection to said terminal.

3. The spade lug of claim 1 wherein the combined lengths of said extension and said one leg is greater than the length of the other leg.

* * * * *